US008077032B1

(12) United States Patent
Vier et al.

(10) Patent No.: US 8,077,032 B1
(45) Date of Patent: Dec. 13, 2011

(54) SYSTEM AND METHOD FOR SELECTIVELY PROVIDING SECURITY TO AND TRANSMISSION POWER FROM A PORTABLE ELECTRONIC DEVICE DEPENDING ON A DISTANCE BETWEEN THE DEVICE AND A USER

(75) Inventors: Bradford Edward Vier, Austin, TX (US); Todd Winfield Steigerwald, Austin, TX (US)

(73) Assignee: Motion Computing, Inc., Austin, TX (US)

( * ) Notice: Subject to any disclaimer, the term of this patent is extended or adjusted under 35 U.S.C. 154(b) by 1254 days.

(21) Appl. No.: 11/745,148

(22) Filed: May 7, 2007

Related U.S. Application Data

(60) Provisional application No. 60/746,532, filed on May 5, 2006.

(51) Int. Cl.
*G08B 1/08* (2006.01)

(52) U.S. Cl. ..... 340/539.23; 340/3.1; 340/8.1

(58) Field of Classification Search ..... 340/3.1, 340/539.22, 539.23, 554, 686.6, 600, 573.1, 340/825.49, 5.54, 5.85, 8.1, 529, 550, 691.3; 455/572, 574, 127.1–127.5, 522, 410, 411; 713/300, 194; 726/34, 35, 36
See application file for complete search history.

(56) References Cited

U.S. PATENT DOCUMENTS

| | | | | |
|---|---|---|---|---|
| 3,668,703 | A * | 6/1972 | Klein | 342/28 |
| 3,947,834 | A | 3/1976 | Gershberg et al. | |
| 4,197,537 | A | 4/1980 | Follen et al. | |
| 4,286,260 | A | 8/1981 | Gershberg et al. | |
| 4,656,462 | A * | 4/1987 | Araki et al. | 340/556 |
| 5,224,151 | A * | 6/1993 | Bowen et al. | 455/569.1 |
| 5,440,290 | A * | 8/1995 | McCullough et al. | 340/552 |
| 5,541,609 | A * | 7/1996 | Stutzman et al. | 343/702 |
| 5,805,067 | A * | 9/1998 | Bradley et al. | 340/635 |
| 6,064,857 | A * | 5/2000 | Wiedeman et al. | 455/127.4 |
| 6,374,145 | B1 * | 4/2002 | Lignoul | 700/17 |
| 2003/0064732 | A1 * | 4/2003 | McDowell et al. | 455/456 |
| 2003/0064761 | A1 * | 4/2003 | Nevermann | 455/572 |

* cited by examiner

*Primary Examiner* — Edwin Holloway, III
(74) *Attorney, Agent, or Firm* — Charles D. Houston; Daffer McDaniel, LLP

(57) ABSTRACT

A portable electronic device is provided for sending and receiving a communication signal to and from a target, respectively. Among other components, the portable electronic device includes an antenna, a transceiver, a signal processing system and control circuitry. The signal processing system determines a distance between the target and the portable electronic device. There are various ways to determine the relative distance between the target and the device. One such methodology is to use a change in a signal that is transmitted from the transceiver and reflected from the target back to the transceiver. The change can be a frequency shift, a phase shift, a capacitive coupling change, an impedance change, or any other change which notes the presence of a target relative to the transceiver. The control circuitry may be used to change the amount of power applied to the antenna and/or to change at least one security measure of the device depending on the distance detected between the target and the device.

26 Claims, 3 Drawing Sheets

SYSTEM AND METHOD FOR SELECTIVELY PROVIDING SECURITY TO AND TRANSMISSION POWER FROM A PORTABLE ELECTRONIC DEVICE DEPENDING ON A DISTANCE BETWEEN THE DEVICE AND A USER

PRIORITY CLAIM

This application claims priority to U.S. Provisional Application No. 60/746,532 filed May 5, 2006.

BACKGROUND OF THE INVENTION

1. Field of the Invention

The present invention relates in general to the field of electronic devices and, more particularly, to a portable electronic device that can sense the presence of a user and apply appropriate security measures to the device and/or variable transmission power from the device depending on a distance between the device and the user.

2. Description of the Related Art

The following descriptions and examples are given as background only.

As used herein, an "electronic device" is any device which contains circuitry that allows for communication to and from possibly another electronic device over a transmission medium. The transmission medium can be wired or wireless and the communication signal can be electrical, optical or acoustic. Each electronic device separated by the transmission medium may include a transceiver, which comprises both a transmitter and a receiver. The transceiver can be operably connected to an antenna, which is configured for transmitting and receiving a communication signal at a given power level.

In some cases, it may be desirable to maximize the transmission power supplied to the transmitter, so as to increase the distance and fidelity of the transmitted signal at the receiver end. Unfortunately, radio antennas embedded within portable electronic devices, which are sold both in the United States and Europe, are not allowed to exceed a particular transmission level when the transmitter is placed relatively close to a user. For instance, a mobile phone is one example of a "portable electronic device" that is often held relatively close to a user's ear. If the mobile phone is placed within, for example, two inches of the user's ear, federal regulations will prevent the mobile phone from transmitting at a power level above, for example, 300 mW. This restriction undesirably limits the distance and fidelity of the signals transmitted from the mobile phone (and other portable electronic devices).

One purpose behind forcing some portable electronic devices to transmit at lower transmission power levels is to minimize any electromagnetic energy which could permeate the human body—possibly causing damage thereto. However, the portable electronic device may not be held close to the user at all times. In many instances, there are times during which the portable electronic device may be held at a remote distance away from the user. For example, a tablet computer is another example of a relatively thin, portable electronic device, which often includes a transceiver for sending and receiving communication signals. When held by a user (e.g., on a user's lap or arm), the transmitter included within the tablet computer generally falls within the two inch range during normal usage conditions. However, there may be times during which the tablet will be placed on a table, away from the user's lap or arm, and thus, further than two inches away from the user.

Therefore, it would be desirable to provide a means for selectively changing the transmission power level based on a distance detected between the user and the portable electronic device. This would allow the transmission power to be increased when the portable electronic device is outside of the specified range, and decreased when the portable electronic device is placed relatively close to the user within the specified range. In some cases, it would also be desirable to apply various security measures within the electronic device, depending on the distance detected between the user and the electronic device. For example, as a user approaches the device, heightened security measures can be taken within the device to prevent unauthorized use. Conversely, if a user is outside the range of interest, security measures can be lessened. These benefits are not presently available to conventional portable electronic devices. Thus, it would be desirable to implement one or more of these measures in an improved portable electronic device hereof.

SUMMARY OF THE INVENTION

The problems outlined above are in large part solved by portable electronic devices and methods for selectively providing security to and/or transmission power from the portable electronic device depending on a distance detected between the device and a user. The following description of various embodiments of portable electronic devices and methods is not to be construed in any way as limiting the subject matter of the appended claims.

According to one embodiment, the portable electronic device includes an antenna and a transceiver. Coupled to the transceiver is a signal processing system that senses the presence of a user and selectively changes transmission power and/or security access, depending on the distance detected between the device and the user. In general, the signal processing system may include a proximity sensor and a comparator coupled to that sensor. The comparator can receive one or more predetermined distance values from a memory storage unit, and compare that predetermined distance value with a distance detected by the proximity sensor. Depending on the outcome of the comparison operation, the comparator may signal a control circuit to change one or more operational features of the portable electronic device. In a general embodiment, the control circuitry may simply be a multiplexer, or possibly a switch array, that receives a select signal output from the comparator.

According to a first embodiment, the comparator may output a select signal to the control circuitry for selectively changing the transmission power level. For example, if the detected distance value is greater than the predetermined distance value, the control circuitry may cause a power control block of the portable electronic device to increase the amount of power applied to the antenna (e.g., to a high transmission power level). Conversely, if the detected distance value is less than the predetermined distance value, the control circuitry may cause the power control block to decrease the amount of power applied to the antenna (e.g., to a low transmission power level).

According to the first embodiment, the transmission power level of the portable electronic device can be varied between a low transmission power level (to comply with close-range power requirements) when operated within a government-regulated distance, and a high transmission power level (to improve performance) when operated outside of the government-regulated distance. In some cases, the highest permissible power level can be applied when operated outside of the government-regulated distance to maximize the distance and fidelity of the transmitted signal. Thus, instead of marketing only a low power product, the portable electronic device described herein can be simultaneously configured to meet government regulations as a low power device, while maintaining the ability to boost its transmission power when operating outside the government-imposed region.

In one example, the portable electronic device can selectively apply about 300 mW of power to the antenna when the transmitter is within about 2" of the user, or about 750 mW of power when the transmitter is outside of the 2" distance. This may enable the portable electronic device to meet FCC and SAR regulations in the United States (and similar regulations in other countries) when operating within the government-mandated distance. However, the portable electronic device described herein maintains the ability to supply significantly greater transmission power (thus, providing greater distance and fidelity) when operating outside of the government-mandated distance.

According to another embodiment, the comparator may output a select signal to the control circuitry for sending either an alarm signal or a non-alarm signal to a security control block of the portable electronic device. For example, a non-alarm signal may be selected, if the presence of a target, such as a human body, is either not detected or detected outside of the predefined distance. In most cases, selection of the non-alarm signal may cause the portable electronic device to take no further action.

On the other hand, an alarm signal may be selected, if the presence of a target, such as a human body, is detected within the predefined distance. In most cases, the alarm signal may be supplied to the security control block to deactivate the portable electronic device and/or prevent a user from accessing the device unless the user overrides the security feature (e.g., by initiating a certain sequence of buttons on the keyboard, GUI screen, etc.) to unlock the portable electronic device. Alternatively, or in addition, the alarm signal can signal a logging of a user being within the predefined distance, or be sent to a speaker to send an audible tone. The alarm signal may be used to perform other functions as described further herein.

Therefore, the portable electronic device described herein utilizes proximity sensing for various purposes. For example, proximity sensing may be used to provide close proximity protection to physical bodies or human beings, as well as to warn of short-range intrusion for purposes of security. Sensing a human body approaching or leaving the short-range distance can be achieved in numerous ways. For example, sensing can be carried out using Doppler detection, capacitive sensing, or any phase shift sensing of a transmit signal. In phase shift sensing, a transmit signal is sent from the portable electronic device to a target or human body. The signal returned to the transceiver will incur a phase shift as it is placed back onto the transceiver that sent the sense signal. The amount of phase shift may then be used to determine the short range distance.

In some cases, the proximity sensor may use the same antenna as that which transmits the communication signal (i.e., voice, video, audio, etc.) to another electronic device for determining the distance between the electronic device and the target. In other cases, a separate antenna may be used for determining the distance. In one embodiment, the transmit power can be automatically toggled from a high power transmit level to a low power transmit level as a human body moves into and out of the critical range. In another embodiment, security measures may be taken if a person intrudes into the distance barrier and does not use a finger print reader (FPR) or other disable mechanism (e.g., a combination code) within a predefined time period. In some cases, the portable electronic device may respond to a security breach by sounding an alarm, sounding a security message, locking down the operating system or hard drive of the electronic device, reporting the intrusion to a web URL security site, or simply disabling the electronic device in its entirety.

Broadly speaking, a portable electronic device is provided having a transceiver for sending and receiving a signal to and from a target, such as a human body. A signal processing system is coupled to the transceiver for determining a distance between the target and the device, depending on a change between the sent and received signal. That change can be a frequency shift, a phase shift, a capacitive coupling change, an impedance change, or any other change which notes the presence of a target relative to the transceiver. Control circuitry is coupled to the signal processing system for changing the amount of power applied to the antenna of the device and/or for changing at least one security measure of the device, depending on the distance detected between the target and the device. The portable electronic device may be selected from a group comprising mobile phones, personal digital assistants (PDAs), laptop computers and tablet computers, among others.

According to another embodiment, a method is provided herein for changing the transmission power of a portable electronic device. The method includes detecting a distance between a target and the portable electronic device, and comparing the detected distance to a predetermined distance value. Transmission power may be changed if the detected distance exceeds or is less than the predetermined distance value. For example, the transmission power may be increased if the detected distance is greater than the predetermined distance value, and decreased if the detected distance is less than the predetermined distance value.

According to another embodiment, a method is provided herein for changing at least one security measure of a portable electronic device. The method includes detecting a distance between a target and the portable electronic device, and comparing the detected distance to a predetermined distance value. At least one security measure may be changed if the detected distance exceeds or is less than the predetermined distance value. For example, the at least one security measure may be activated if the detected distance is less than the predetermined distance value, and deactivated if the detected distance is greater than the predetermined distance value.

BRIEF DESCRIPTION OF THE DRAWINGS

Other objects and advantages of the invention will become apparent upon reading the following detailed description and upon reference to the accompanying drawings in which.

Figure 1:
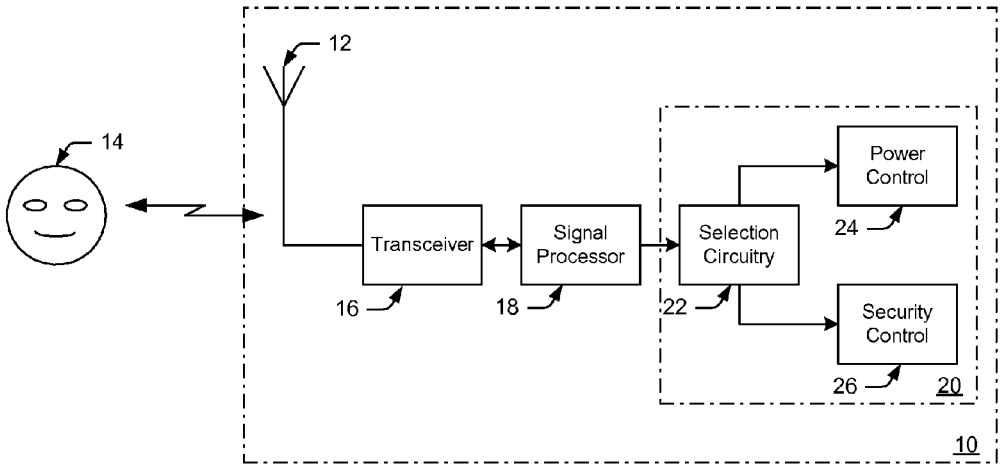
FIG. 1 is a block diagram of a portable electronic device having an antenna, a transceiver and a signal processing system that senses the presence of a user and selectively changes transmission power and/or security access depending on the distance detected between the device and the user.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

As technology advances, portable electronic devices have become increasingly popular for both personal and business use. Unfortunately, many of today's portable electronic devices suffer drawbacks in performance and/or ease of use. One drawback relates to transmission power level, another relates to security. A novel approach for overcoming one or more of these drawbacks will be described in reference to FIGS. 1-6. However, specific problems will first be addressed in more detail below.

First of all, many portable electronic devices provide wireless communication by including at least one radio (i.e., an antenna and transceiver) within the device for sending and receiving communication signals. The communication signals may be sent/received over a variety of networks (e.g., WLAN and WWAN) in accordance with many well-known communication standards and protocols (e.g., Wi-Fi, GSM, PCS, EDGE, GPRS and UTMA). In an effort to protect users from unwanted electromagnetic radiation, regulatory bodies have placed power level restrictions on WLAN and WWAN radios embedded within portable electronic devices sold in both the US and Europe. However, these restrictions undesirably limit the performance of many portable electronic devices by reducing the distance and fidelity of signals transmitted from the embedded radios.

In particular, FCC and SAR regulations state that low power WLAN and WLAN radios must be used within portable electronic devices, if the transmitting antenna is to be placed within the vicinity of the user (e.g., within a range less than about 2-10" from the user) during normal usage conditions. These low power radios provide the benefit of reducing the amount of electromagnetic radiation absorbed by the user by supplying less than about 300 mW of power to the transmitting antenna. However, lower transmission power undesirably affects antenna performance by reducing the distance and fidelity of the transmitted signal.

Larger portable electronic devices are generally unaffected by the FCC and SAR regulations mentioned above. For example, high power WLAN and WWAN radios capable of broadcasting above 300 mW are often incorporated within laptop computers. The larger size of these devices enables the manufacturer to circumvent FCC and SAR regulations by placing the transmitting antenna (e.g., within the LCD frame), so that it remains a spaced distance away from the user (e.g., greater than about 10") during normal usage conditions. Unfortunately, smaller portable electronic devices, such as mobile phones, tablet computers and other handhelds, are restricted from using high power radios, and thus, fail to provide the level of performance found in larger devices.

As described in more detail below, a portable electronic device is provided herein, which overcomes the performance issues typically associated with smaller electronic devices, while meeting FCC and SAR regulations. For example, the portable electronic device may utilize proximity sensing to vary the transmission power based on a distance detected between the device and the user. This enables the portable electronic device to comply with FCC and SAR regulations by decreasing the transmission power to an acceptable level (e.g., about 300 mW) when operated within the vicinity of the user (e.g., within a range of about 2-10" of the user). However, the portable electronic device is not strictly a low power device. Unlike most small portable electronic devices, the device described herein maintains the ability to increase transmission power to a significantly higher level (e.g., about 750 mW) when operated a spaced distance (e.g., greater than about 10") away from the user.

Second, many portable electronic devices provide at least one security measure for protecting the device from unauthorized use. For example, the security measures used in conventional devices may include password protection and/or physical locking mechanisms that prevent an unauthorized person from gaining access to the device. Unfortunately, these security measures are often cumbersome and annoying to someone leaving the device unattended often.

As described in more detail below, the portable electronic device provided herein may use proximity sensing to selectively activate one or more internal security measures based on a distance detected between the device and the user. For example, the portable electronic device may automatically activate one or more internal security measures whenever a foreign body intrudes within a "security zone" surrounding the device (e.g., within a range of about 0-48" surrounding the device). The security measures may be deactivated automatically when the foreign body leaves the security zone, or manually if an unlock sequence is completed within a predefined period. In any case, the security features described herein provide a desired level of protection while minimizing user involvement.

Turning now to the drawings, FIG. 1 illustrates an electronic device 10 having an antenna 12, which transmits and receives a signal to and from, respectively, a target 14. Target 14 can be a human body, for example. Electronic device 10 can be any portable electronic device which contains circuitry that allows for communication to and from another electronic device over a transmission medium. An electronic device is said to be portable if it is typically carried or held by a user during normal usage. Examples of portable electronic devices include, but are not limited to, mobile phones, personal digital assistants (PDAs), laptop computers and tablet computers. Although a tablet computer is specifically used in the examples mentioned below, the inventive concepts described herein may be applicable to other portable electronic devices.

In the general embodiment of FIG. 1, antenna 12 is configured for transmitting and receiving signals under the control of transceiver 16 and signal processor 18. The transmitted signal can be sent from signal processor 18, and the returned signal can be received upon signal processor 18. Signal processor 18 can be any processing system (such as an execution unit with memory) configured for determining a distance between device 10 and target 14. As described in more detail below, signal processor 18 may use proximity sensing to determine the distance based on changes detected between the transmitted and returned signals. The detected changes may include a phase shift, a frequency shift, a capacitive coupling change, an impedance change, or any other change which notes the presence of a target relative to the device.

Unlike conventional devices, control circuitry 20 may be included for selectively providing security to and/or transmission power from device 10 based on the distance detected between device 10 and target 14. As shown in FIG. 1, control circuitry 20 may include selection circuitry 22 and at least one of power control block 24 and security control block 26. Selection circuitry 22 may be coupled for receiving one or more select signals (SEL) from signal processor 18, based on the distance detected between device 10 and target 14. As described in more detail below, the one or more select signals may cause selection circuitry 22 to send an appropriate control signal to power control block 24 and/or security control block 26. Various components of portable electronic device 10 will now be described in reference to FIG. 2.

In some embodiments, antenna 12 may be used for both communication and proximity sensing purposes. For example, the signals sent from and received by antenna 12 may be used for communicating with other electronic devices during a first time period, and for determining a distance between portable electronic device 10 and target 14 (e.g., a potential user of the device) during a second time period. The second time period may occur anytime before, during or after the first time period. In other embodiments, antenna 12 may be used solely for proximity sensing purposes. In some cases, an additional antenna (not shown) may be included within portable electronic device 10 to provide wireless communication to other electronic devices. In other cases, communication between portable electronic device 10 and other electronic devices may be conducted over a wired transmission medium (not shown).

In one embodiment, antenna 12 may be substantially any type of antenna capable of transmitting and receiving signals. In one embodiment, antenna 12 may be embedded within or otherwise attached to one side of portable electronic device 10 when the device comprises a tablet computer. For example, antenna 12 may be fixedly attached to the right-hand side of the tablet computer frame. However, antenna 12 is not restricted to the right-hand side of the tablet computer frame in all embodiments of the invention, and may be alternatively arranged in other embodiments of the invention. Regardless of the particular arrangement, antenna 12 will typically be placed within a distance of less than about 2" from a user when the tablet computer 10 is held by the user (e.g., on the user's lap or arm). This is due, at least in part, to the relative thinness of tablet computer 10 and other small, portable electronic devices.

Figure 2:
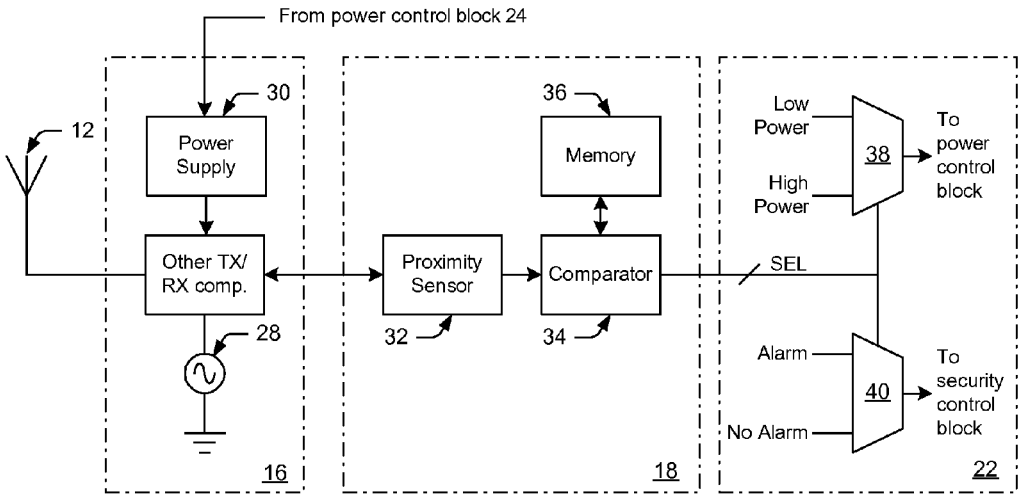
FIG. 2 is a block diagram illustrating one embodiment of the transceiver, signal processor and selection components shown in FIG. 1.

Antenna 12 and transceiver 16 may be configured for broadcasting and receiving signals at substantially any frequency or range of frequencies. As known in the art, transceiver 16 may include transmitting and receiving components. For example, transceiver 16 may include a modulator (not specifically shown) for modulating the signal information onto a carrier frequency, which is then broadcast. One or more amplifiers (not specifically shown) may be included for amplifying the modulated signal before it is broadcast from antenna 12, and/or for amplifying a signal received by antenna 12. As shown in FIG. 2, oscillator 28 may be coupled to transceiver 16 for supplying the transmit frequency thereto. In addition, power supply 30 may be included for applying transmission power to antenna 12. As described in more detail below, the amount of transmission power applied to antenna 12 may be varied based on a distance detected between portable electronic device 10 and target 14.

As shown in FIG. 2, signal processing system 18 may include a proximity sensor 32, a comparator 34, and a memory 36 in at least one embodiment of the invention. Proximity sensor 32 may include any circuit that can measure a change in a signal transmitted from transceiver 16, reflected from target 14 and returned to transceiver 16. The change measured between the transmitted and received signals may include a phase shift, a frequency shift, a capacitive coupling change, an impedance change, or any other change which notes the presence of a target relative to the device. As described in more detail below, proximity sensor 32 may utilize a number of different circuit configurations to determine the distance between target 14 and device 10.

In some embodiments, proximity sensor 32 may utilize counters, phase-locked loops, or other circuitry capable of detecting a difference in frequency, phase or delay between the transmitted and received signals. Although such an embodiment may provide a relative distance between target 14 and device 10, it may not distinguish between approaching and receding targets. In some embodiments, proximity sensor 32 may use frequency shifted signals to determine if a target is approaching or receding away from the electronic device 10. Specifically, proximity sensor 32 may utilize a Doppler shift technique for detecting movement of a target within a protected space surrounding electronic device 10. The Doppler shift technique is characterized by transmitting microwave energy into an area surrounding the device to be protected, and subsequently receiving a portion of the transmitted energy reflected from any objects which happen to be within the protected area. Any frequency change of the reflected energy, as compared to the transmitted energy, will indicate that an object is moving within the protected area. The direction of movement may be obtained by using separate components (e.g., amplifiers, rectifiers, integrators and comparators) for the approach and recede signals.

In other embodiments, proximity sensor 32 may use capacitive sensing to measure a change in capacitance due to the presence or absence of a target within a given proximity of the capacitance body sensor 32. For example, a human body demonstrates a different capacitance than, for example, air. When a human body is brought within a specified range of the body sensor, the impedance measured by that sensor changes, and that impedance affects the frequency of oscillation within, for example, oscillator 28. In some cases, the change in oscillation frequency may be used to determine the presence or absence of a target within the vicinity of the portable electronic device 10. In some cases, the change in oscillation frequency may also be used to determine the direction in which the target is moving (i.e., whether the target is approaching or receding away from the device).

In one example (not shown), capacitive body sensor 32 may include an LC circuit having a known impedance. The impedance seen across the LC circuit changes when a target moves within a specified range (e.g., about 0-48") of the circuit. As noted above, the change in impedance may cause the frequency of oscillator 28 to change. In some cases, the change in oscillation frequency may be measured (e.g., by a monostable multivibrator) and bandpass filtered to determine the upper and lower maximums (or "tones") of the oscillation frequency. Voltage comparators may then be used to determine whether the upper and lower tones respectively exceed predefined high frequency and low frequency levels. The voltage comparators may determine that the target is approaching the device if the upper tone exceeds the predefined high frequency level. On the other hand, the voltage comparators may determine that the target is receding away from the device, if the lower tone exceeds the predefined low frequency level.

Comparator 34 is generally configured for comparing the distance measured by proximity sensor 32 relative to one or more predetermined distance values stored within memory 36. In some cases, an input/output circuit (not shown) can be used to forward the predetermined distance value(s) into memory 36, and to read those value(s) out from memory 36, if needed. Depending on whether the measured distance exceeds or is less than the predetermined distance value(s), an appropriate select signal is sent from comparator 34 to selection circuitry 22.

In one embodiment, selection circuitry 22 may include a pair of multiplexers 38 and 40, as shown in FIG. 2. Multiplexers 38 and 40 can be configured for selecting an Alarm or Low Power control signal if the measured distance is less than the predetermined value(s) or, alternatively, a No Alarm or High Power control signal if the measured distance is greater than the predetermined value(s). The control signals output from multiplexers 38 and 40 are forwarded to power control block 24 and security control block 26, respectively (FIG. 1).

In some embodiments, comparator 34 may use the same predetermined distance value for power and security purposes. For example, comparator 34 may generate a single select signal (SEL) based on the comparison between the measured distance and a predetermined distance of about 2". As shown in FIG. 2, the SEL signal may be supplied to the control inputs of multiplexers 38 and 40 for selecting the appropriate control signals.

In other embodiments, comparator 34 may use different predetermined distance values for power and security purposes. For example, comparator 34 may generate a first select signal (not shown in FIG. 2) based on a first comparison between the measured distance value and a predetermined distance value of about 2". The first select signal may be supplied to the control input of multiplexer 38 for selecting between the Low Power and High Power control signals. In addition, comparator 34 may generate a second select signal (not shown in FIG. 2) based on a second comparison between the measured distance value and a predetermined distance value of about 48". The second select signal may be supplied to the control input of multiplexer 40 for selecting between the Alarm and No Alarm control signals. In some cases, comparator 34 may actually include two comparators, each coupled to proximity sensor 32 and memory 36, for performing the comparison operations.

Although exemplary predetermined distance values are provided herein, one skilled in the art would understand that the comparison operation(s) are not limited to only those values specifically mentioned herein. In some cases, comparator 34 may receive substantially smaller or larger predetermined distance values from memory 36 for comparison with the measured distance value. In fact, the range of predetermined values stored within memory 36 may only be limited by the type of proximity sensor 32 used within signal processor 18 and the comparison mode desired.

For example, a capacitive-based proximity sensor 32 may only be capable of detecting a target within a range of about 0-48" from the device. On the other hand, a Doppler-based proximity sensor 32 may be capable of detecting a target within a range of about 0"-20' from the device. Other types of proximity sensors may be capable of detecting targets within similar or different ranges. As such, the predetermined distance values stored within memory 36 may generally depend on the type of proximity sensor 32 used within signal processor 18. However, regardless of the particular type of sensor chosen, proximity sensor 32 may be configured for detecting targets within a relatively close range surrounding device 10 (e.g., about 0-48" from the device). As such, proximity sensor 32 may be generally classified as a short-range detection device.

In some cases, the predetermined distance values stored within memory 36 may also depend on the desired comparison mode. For example, the predetermined distance values may include a range of values between about 0-10" when signal processor 18 is configured for operating in a Low Power/High Power comparison mode. When operating in an Alarm/No Alarm comparison mode, the predetermined distance values may include a range of values between about 0-48". Signal processor 18 may be configured for operating in only one mode, the other mode or both modes simultaneously.

Security control block 26 can be any circuitry which, upon receiving a control signal noting an Alarm condition, takes appropriate security measures to lock down device 10 until a desired user activates the appropriate unlock sequence. In some cases, device 10 may respond to a security breach by locking down the operating system or hard drive of the electronic device or by disabling the electronic device in its entirety. Alternatively, or in addition to locking down the device, security control block 26 may log the intrusion (e.g., by reporting the intrusion to a web URL security site or internal security log), sound an audible alarm signal, sound an audible security message or otherwise note the intrusion condition which triggered the alarm.

In most cases, the alarm is triggered when a human body is detected within a barrier radius of transceiver 16 (e.g., within about 0-48" of the transceiver) and security measures are automatically applied. In some cases, the security measures may be automatically deactivated when the human body exits the barrier radius. In other cases, the security measures may be manually deactivated by an authorized user of the device. For example, the user may deactivate the security measures by inputting an unlock sequence within a predefined period of time (e.g., 5 sec, 10 sec, 30 sec, or any other appropriate time frame). Examples of suitable unlock sequences may include, but are not limited to, actuating a predefined sequence of keys on device 10 to input a pre-set combination code and using a finger print reader (FPR) or other biometric sensor capable of identifying authorized users of the device.

Power control block 24 can be any circuitry which, upon receiving a control signal noting a Low Power condition, takes the appropriate measures to reduce the amount of power supplied to antenna 12 (e.g., to about 300 mW). Power control block 24 may only reduce transmission power when a target (such as a human body) is detected within the vicinity of the portable electronic device (e.g., within about 0-10" of the transceiver). The power control block 24 may increase or maintain the transmission power at a relatively high level (e.g., about 750 mW) at all other times. As such, power control block 24 may be configured for modulating the level of the power supply 30 which feeds the transmitter, so that if the barrier is intruded upon, the transmitter will automatically toggle to a low power transmission mode. No input is needed from the user to toggle between low and high power modes.

One embodiment of a portable electronic device capable of selectively providing security to and/or transmission power from the portable electronic device, depending on a distance detected between the device and a user, has now been described. Preferred and alternative embodiments of the portable electronic device are set forth below.

As noted above, proximity sensor 32 may use a number of different techniques to determine the distance between target 14 and device 10. In one preferred embodiment of the invention, proximity sensor 32 may use a capacitive sensing technique to determine the distance based on a change in capacitance (or impedance) detected between signals transmitted and returned to antenna 12. A capacitive-based proximity sensor may be preferred, in at least one embodiment of the invention, for its relatively low cost and power consumption. However, other types of proximity sensors may be used in alternative embodiments of the invention. Examples of suitable proximity sensors include, but are not limited to, circuits capable of detecting a change in frequency or phase between microwave, ultrasonic or radio frequency signals.

Figure 3:
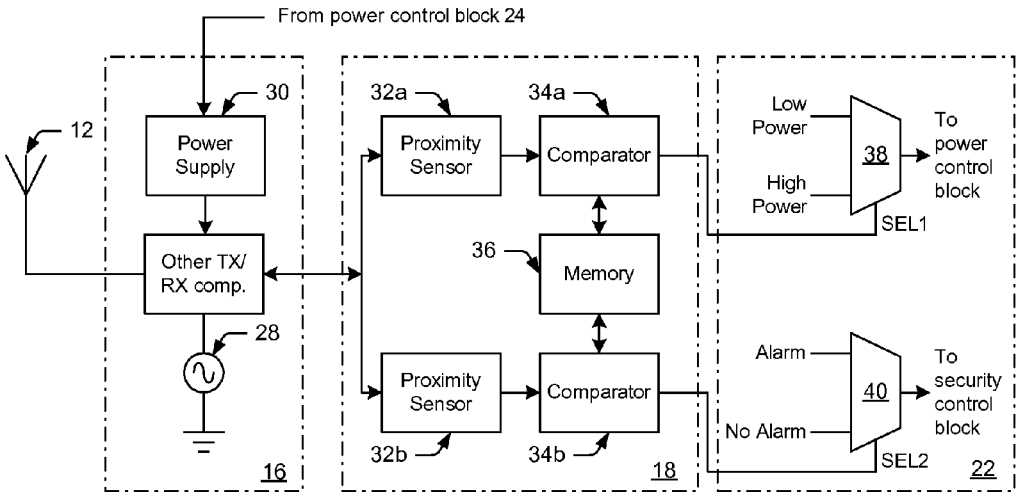
FIG. 3 is a block diagram illustrating another embodiment of the transceiver, signal processor and selection components shown in FIG. 1.

In some embodiments, signal processor 18 may include more than one proximity sensor 32 and more than one comparator 34. As shown in FIG. 3, one proximity sensor/comparator pair 32*a*/34*a* may be used for power modulation purposes, while another proximity sensor/comparator pair 32*b*/34*b* is used for security purposes. The proximity sensors 32*a*/32*b* may be of the same type (e.g., two capacitive-based proximity sensors may be used), or may be of completely different type (e.g., a capacitive-based proximity sensor and a Doppler-based proximity sensor may be used). Each comparator 34*a*/34*b* may be coupled to memory 36 for receiving an appropriate predetermined distance value there from. Each comparator 34*a*/34*b* may also be coupled to a different multiplexer (38 or 40) for supplying an appropriate select signal (e.g., SEL1 or SEL2) thereto.

Figure 4:
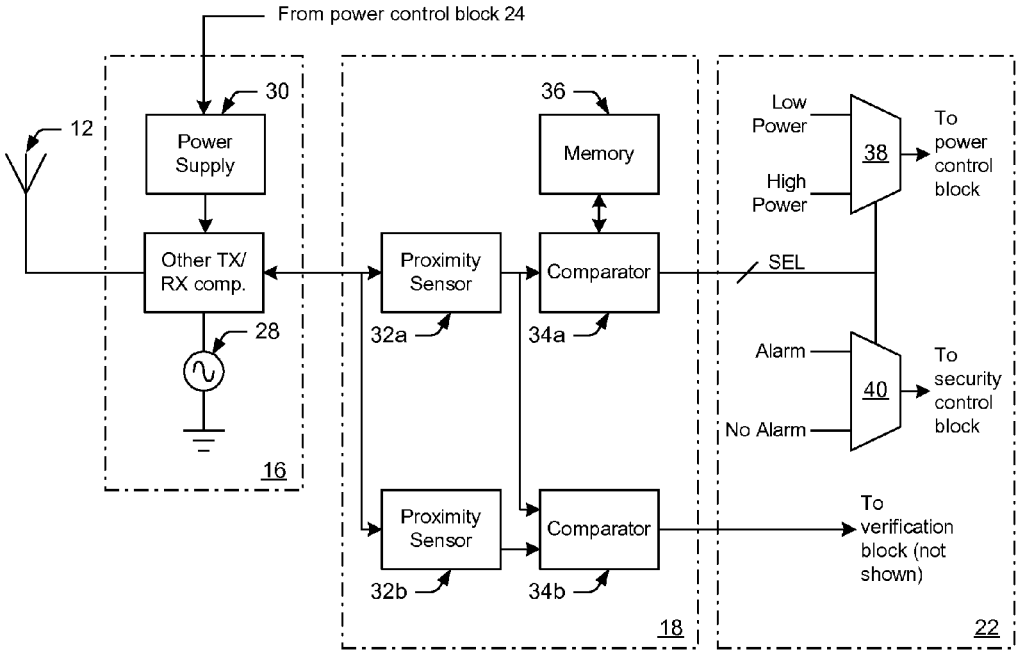
FIG. 4 is a block diagram illustrating yet another embodiment of the transceiver, signal processor and selection components shown in FIG. 1.

In other cases, an additional proximity sensor and comparator may be used for verification purposes, as shown in the embodiment of FIG. 4. For example, proximity sensor 32*a* and comparator 34*a* may be used for measuring a distance between target 14 and device 10 and for comparing the measured distance to one or more predetermined distance values, as described above in reference to FIG. 2. In the embodiment of FIG. 4, however, an additional proximity sensor 32*b* and comparator 34*b* are included for verification purposes. The proximity sensors 32*a*/32*b* may be of the same type (e.g., two capacitive-based proximity sensors may be used), or may be of completely different type (e.g., a capacitive-based proximity sensor and a Doppler-based proximity sensor may be used). However, proximity sensors 32*a* and 32*b* are preferably implemented with different types of sensors to increase confidence in the measured signal. Comparator 34*b* is coupled for comparing the distances values measured by proximity sensors 32*a* and 32*b*. The output of comparator 34*b* is supplied to a verification block (not shown).

If the distance values measured by proximity sensors 32*a* and 32*b* are substantially the same, proximity sensor 32*a* and comparator 34*a* may continue to selectively provide security to and/or transmission power from device 10, as described above in reference to FIG. 2. However, if the distance values measured by proximity sensors 32*a* and 32*b* are significantly different, comparator 34*b* may supply a control signal to the verification block (not shown) to indicate that a discrepancy exists between the measured distance values. In some cases, the discrepancy may cause the verification block to supply an error signal or message to the device 10. In some cases, a user of the device may simply be alerted to the discrepancy (e.g., the error signal or message may be displayed upon device 10). In other cases, the error signal or message may cause the device to: (i) assume default power levels and/or security measures, or (ii) temporarily prevent the power levels and/or security measures from changing.

Exemplary methods (50, 60) for selectively providing transmission power from and security to a portable electronic device will now be described in reference to FIGS. 5 and 6. In some cases, the methods may begin by detecting a distance between a target and a portable electronic device (in steps 52 and 62). As noted above, the target may generally be a human body. The portable electronic device may generally be any electronic device, which is typically carried or held by a user during normal usage (e.g., a mobile phone, PDA, laptop computer or tablet computer, among others). The distance between the target and the portable electronic device may be detected by any means known in the art. Examples of proximity sensing circuits that may be used for detecting the distance are provided above.

Figure 5:
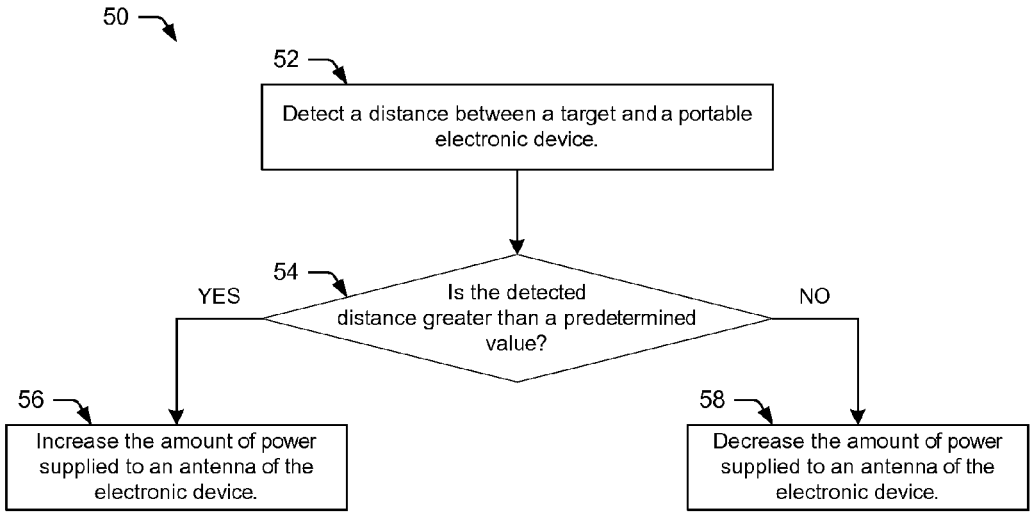
FIG. 5 is a flow chart diagram illustrating one embodiment of a method for changing a transmission power of a portable electronic device.

Referring to FIG. 5, the method may continue by determining whether or not the detected distance is greater than a predetermined distance value (in step 54). In some cases, the predetermined distance value may be approximately 2". In other cases, the predetermined distance value may correspond to a distance value chosen by a regulatory body (such as the FCC or SAR) to reduce radiated emissions from the portable electronic device. In other cases, the predetermined distance value may include any distance value deemed appropriate by a manufacturer of the portable electronic device.

If the detected distance is greater than the predetermined distance value (YES branch of step 54), the method shown in FIG. 5 may maintain or increase the amount of power available to a transmitting antenna of the portable electronic device (in step 56). In some cases, the transmission power may be maintained or increased to a relatively high power level (e.g., above approximately 300 mW) when the detected distance falls outside of a government-mandated barrier radius of about 0-10". In one example, the relatively high power level may be about 750 mW. However, other relatively high power levels may be appropriate in other examples.

If the detected distance is less than or equal to the predetermined distance value (NO branch of step 54), the method shown in FIG. 5 may decrease the amount of power available to the transmitting antenna of the portable electronic device (in step 58). In some cases, the transmission power may be decreased to a relatively low power level (e.g., about 300 mW or below) when the detected distance falls within a government-mandated barrier radius of about 0-10". In one example, the relatively low power level may be about 300 mW. However, other relatively low power levels may be appropriate in other examples.

Figure 6:
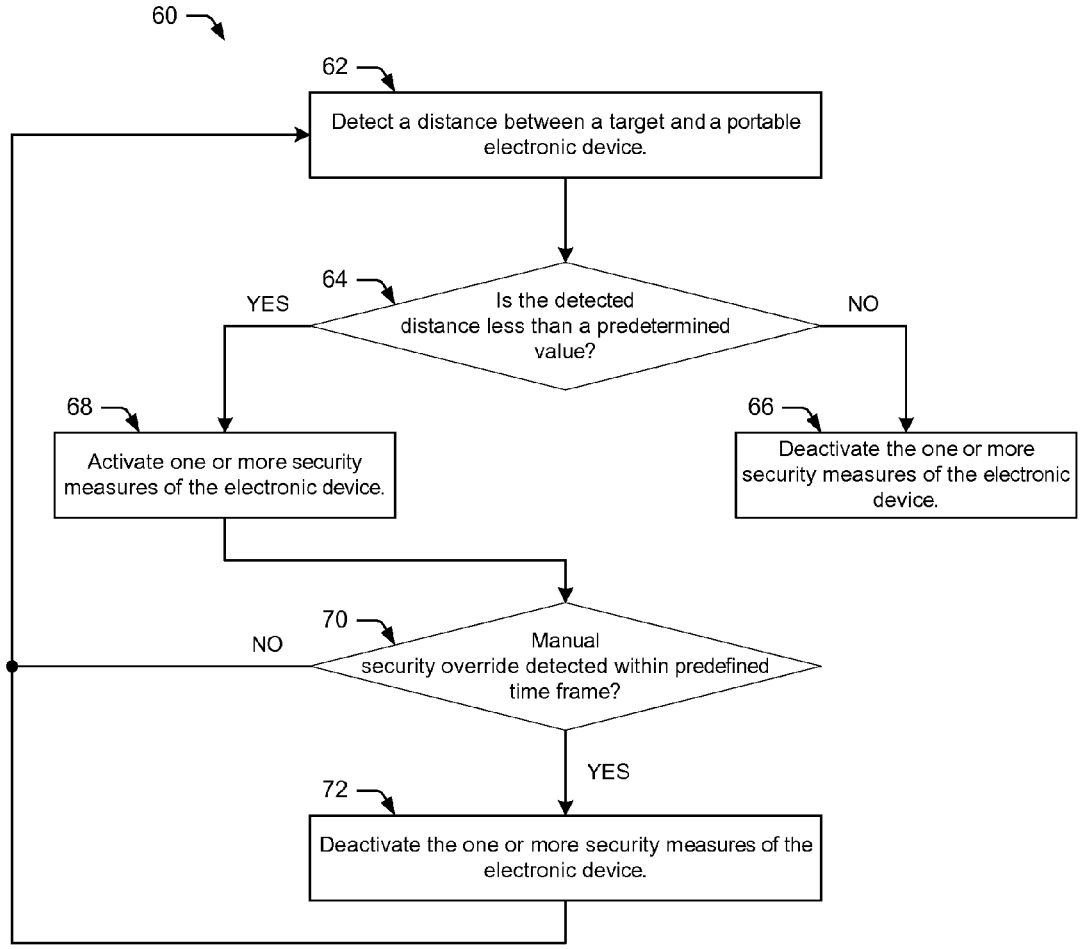
FIG. 6 is a flow chart diagram illustrating one embodiment of a method for changing at least one security measure of a portable electronic device.

Referring to FIG. 6, the method may continue by determining whether or not the detected distance is less than a predetermined distance value (in step 64). In some cases, the predetermined distance value may be approximately 48". In other cases, the predetermined distance value may be substantially any other close-range value, which provides adequate protection to the electronic device when left unattended by an authorized user. A close-range value may be chosen to minimize over-activation of security measures due to human activity or other environmental activity around the device, but not in the direct vicinity of the device.

If the detected distance is greater than or equal to the predetermined distance value (NO branch of step 64), the method shown in FIG. 6 may do nothing or it may deactivate one or more security measures, which were previously activated by an approaching target (in step 66). In other words, the portable electronic device may be left unlocked as long as no targets are detected within a predetermined distance from the device.

If the detected distance is less than the predetermined distance value (YES branch of step 64), the method shown in FIG. 6 may activate one or more security measures of the portable electronic device (in step 68). As noted above, the one or more security measures may include, but are not limited to, sounding an alarm, sounding a security message, locking down the operating system or hard drive of the electronic device, reporting the intrusion to a web URL security site, or simply disabling the electronic device in its entirety.

Once activated, the one or more security measures may be deactivated in one of two ways. In some cases, the one or more security measures may be manually deactivated by an authorized user of the device (in step 72) if an unlock sequence (or manual security override) is detected within a predefined time frame (in step 70). As noted above, the user may deactivate the one or more security measures by actuating a predefined sequence of keys on device 10 to input a pre-set combination code, or by using a finger print reader (FPR) or other biometric sensor capable of identifying authorized users of the device. Other means for deactivating the security measures may also be used.

If manual security override is not available or enabled (NO branch of step 70), the activated security measures may remain in place until the target leaves the protected zone surrounding the device. For example, steps 62 and 64 may be repeated until the detected distance is greater than or equal to the predetermined distance value. Once the detected distance exceeds the predetermined distance value, the security features may be automatically deactivated (in step 66).

It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A portable electronic device, comprising:

a transceiver for sending and receiving a signal to and from, respectively, a target;

a signal processing system coupled to the transceiver for determining a distance between the target and the electronic device based on a change detected between the sent and received signal; and control circuitry coupled to the signal processing system for changing an amount of power applied to an antenna of the device based on a comparison between the determined distance and a first predetermined distance value, and for changing at least one security measure of the device based on a comparison between the determined distance and a second predetermined distance value, which is greater than the first predetermined distance value.

2. The portable electronic device as recited in claim 1, wherein the portable electronic device is selected from a group comprising mobile phones, personal digital assistants (PDAs), laptop computers and tablet computers.

3. The portable electronic device as recited in claim 1, wherein the target comprises a human.

4. The portable electronic device as recited in claim 1, wherein the transceiver is configured for sending and receiving the signal in accordance with a communication standard selected from a group comprising Wi-Fi, GSM, PCS, EDGE, GPRS and UTMA.

5. The portable electronic device as recited in claim 1, wherein the control circuitry is configured for increasing the amount of power applied to the antenna to a relatively high level when the distance between the target and the electronic device is greater than the first predetermined distance value, and to a relatively low level when the distance between the target and the electronic device is less than the first predetermined distance value.

6. The portable electronic device as recited in claim 5, wherein the first predetermined distance value is selected from a range comprising about 0 inches to about 10 inches.

7. The portable electronic device as recited in claim 5, wherein the relatively high level comprises about 750 mW, and wherein the relatively low level comprises about 300 mW.

8. The portable electronic device as recited in claim 1, wherein the control circuitry is configured for activating the at least one security measure when the distance between the target and the electronic device is less than the second predetermined distance value, and deactivating the at least one security measure when the distance between the target and the electronic device is greater than the second predetermined distance value.

9. The portable electronic device as recited in claim 8, wherein the second predetermined distance value is selected from a range comprising about 0 inches to about 48 inches.

10. The portable electronic device as recited in claim 8, wherein the at least one security measure is selected from a group comprising sounding an alarm, sounding a security message, locking down an operating system or hard drive of the electronic device, reporting an intrusion to a URL security site, and disabling the portable electronic device.

11. The portable electronic device as recited in claim 1, wherein the signal processing system comprises:

a first proximity sensor coupled for detecting the change between the sent and received signal and configured for generating a first distance value based on said change;

a memory having the first and second predetermined distance values stored therein;

a first comparator coupled for comparing the first distance value to the first predetermined distance value received from the memory and configured for sending a first selection signal to the control circuitry based on said comparison.

12. The portable electronic device as recited in claim 11, wherein the first proximity sensor is selected from a group comprising Doppler-based and capacitive-based proximity sensing circuits.

13. The portable electronic device as recited in claim 11, wherein the signal processing system further comprises:

a second proximity sensor coupled for detecting the change between the sent and received signal and configured for generating a second distance value based on said change; and a second comparator coupled for comparing the second distance value to the second predetermined distance value received from the memory and configured for sending a second selection signal to the control circuitry based on said comparison.

14. The portable electronic device as recited in claim 13, wherein the first proximity sensor and the second proximity sensor each comprise a different type of sensor.

15. The portable electronic device as recited in claim 11, wherein the first selection signal causes the control circuitry to increase the amount of power applied to the antenna when the first distance value is greater than the first predetermined distance value, and decrease the amount of power applied to the antenna when the first distance value is less than the first predetermined distance value.

16. The portable electronic device as recited in claim 13, wherein the second selection signal causes the control circuitry to deactivate the at least one security measure when the second distance value is greater than the second predetermined distance value, and activate the at least one security measure when the second distance value is less than the second predetermined distance value.

17. A method for selectively altering transmission power from and security to a portable electronic device, the method comprising:

detecting a distance between the portable electronic device and a target;

comparing the distance to a first predetermined value and to a second predetermined value, which is greater than the first predetermined value;

decreasing the transmission power of the portable electronic device if the distance is less than the first predetermined value; and activating at least one security measure of the portable electronic device, if the distance is less than the second predetermined value.

18. The method as recited in claim 17, further comprising deactivating the at least one security measure of the portable electronic device, if the distance is greater than the second predetermined value.

19. The method as recited in claim 17, wherein the second predetermined value is selected from a range of values comprising about 0 inches to about 48 inches.

20. The method as recited in claim 17, wherein the at least one security measure is selected from a group comprising sounding an alarm, sounding a security message, locking down an operating system or hard drive of the electronic device, reporting an intrusion to a URL security site, and disabling the portable electronic device.

21. The method as recited in claim 17, wherein said detecting comprises comparing a phase difference between a transmitted signal and a reflection of the transmitted signal sent back to the portable electronic device from the target.

22. The method as recited in claim 17, wherein said detecting comprises comparing a frequency difference between a transmitted signal and a reflection of the transmitted signal sent back to the portable electronic device from the target.

23. The method as recited in claim 17, further comprising increasing the transmission power of the portable electronic device if the distance exceeds the first predetermined value.

24. The method as recited in claim 23, wherein the first predetermined value is selected from a range of values comprising about 0 inches to about 10 inches.

25. The portable electronic device as recited in claim 11, wherein the control circuitry comprises:

a first multiplexer coupled to the first comparator and configured for selecting between a high power state and a low power state based on the first selection signal; and a power control block coupled to the first multiplexer for changing the amount of power applied to the antenna of the portable electronic device based on the selected power state.

26. The portable electronic device as recited in claim 13, wherein the control circuitry comprises:

a second multiplexer coupled to the second comparator and configured for selecting between an alarm state and a no alarm state based on the second selection signal; and a security control block coupled to the second multiplexer for activating/deactivating the at least one security measure based on the selected alarm state.

* * * * *